US007828516B2

(12) United States Patent
Hartmann et al.

(10) Patent No.: US 7,828,516 B2
(45) Date of Patent: Nov. 9, 2010

(54) DEVICE FOR SUPPORT OF AN ADJUSTING RING WHICH ENCOMPASSES AT A DISTANCE A CIRCULAR BLADE CARRIER

(75) Inventors: Martin Hartmann, Bochum (DE); Alexandra Küpper, Mülheim an der Ruhr (DE); Walter Loch, Mülheim an der Ruhr (DE); Vadim Shevchenko, Dortmund (DE)

(73) Assignee: Siemens Aktiengesellschaft, Munich (DE)

( * ) Notice: Subject to any disclaimer, the term of this patent is extended or adjusted under 35 U.S.C. 154(b) by 981 days.

(21) Appl. No.: 11/649,141

(22) Filed: Jan. 3, 2007

(65) Prior Publication Data

US 2007/0154301 A1 Jul. 5, 2007

(30) Foreign Application Priority Data

Jan. 2, 2006 (EP) ..... 06000027

(51) Int. Cl.
*F01D 17/16* (2006.01)
*F04D 29/56* (2006.01)

(52) U.S. Cl. ..... 415/151; 415/160

(58) Field of Classification Search ..... 415/126, 415/127, 151, 167, 159, 160
See application file for complete search history.

(56) References Cited

U.S. PATENT DOCUMENTS 3,558,237 A * 1/1971 Wall, Jr. ..... 415/115
3,736,070 A 5/1973 Moskowitz et al.
3,841,788 A * 10/1974 Sljusarev et al. ..... 415/147
3,990,809 A * 11/1976 Young et al. ..... 415/160
4,035,101 A 7/1977 Glenn
4,130,375 A * 12/1978 Korta ..... 415/161
5,035,572 A 7/1991 Popp
5,538,214 A * 7/1996 Sinila ..... 248/278.1
5,549,448 A 8/1996 Langston
2003/0165384 A1 * 9/2003 Jonsson ..... 415/209.3

FOREIGN PATENT DOCUMENTS

DE 25 13 581 A1 9/1976
DE 103 51 202 A1 6/2005
EP 1 524 413 A2 4/2005

* cited by examiner

*Primary Examiner*—Edward Look
*Assistant Examiner*—Nathaniel Wiehe

(57) ABSTRACT

The invention relates to a device for support of an adjusting ring which encompasses at a distance a basically circular blade carrier, which adjusting ring is rotatable in the circumferential direction around a center axis which is identical with the blade carrier, in order to adjust radially extending blades of a ring of a turbo-engine, wherein a plurality of levers are provided between the blade carrier and the adjusting ring, which levers are distributed over the circumference, extend tangentially in each case, and which on their free ends have a rotatable roller in each case, which are rollable in the circumferential direction on the adjusting ring or on the blade carrier. According to the invention, the lever is tightly clamped on one side to disclose a wear-free and reliable device for support of an adjusting ring which encompasses at a distance a circular blade carrier.

8 Claims, 2 Drawing Sheets

DEVICE FOR SUPPORT OF AN ADJUSTING RING WHICH ENCOMPASSES AT A DISTANCE A CIRCULAR BLADE CARRIER

CROSS REFERENCE TO RELATED APPLICATIONS

This application claims the benefits of European Patent application No. 06000027.0 filed Jan. 2, 2006. All of the applications are incorporated by reference herein in their entirety.

FIELD OF INVENTION

The invention relates to a device for support of an adjusting ring which encompasses at a distance a basically circular blade carrier, which adjusting ring is rotatable in the circumferential direction around a center axis identical with the blade carrier in order to adjust radially extending stator blades of a ring of a turbo-engine.

BACKGROUND OF THE INVENTION

A device of such type originates, for example, from U.S. Pat. No. 5,549,448. In order to adjust the radially extending stator blades of a stator blade ring of a compressor, an adjusting ring, which is concentric to the center axis of the compressor, encompasses its center casing. Each stator blade of the stator blade ring, which is rotatable around its longitudinal axis, is connected in each case by a pivoted lever to the adjusting ring which is rotatable in the circumferential direction. The rotation of the adjusting ring in the circumferential direction brings about a rotation of the stator blades around the respective longitudinal axis by means of the pivoted lever. As a result, the adjusting ring is moved in the circumferential direction by adrive device, which at the same time supports the adjusting ring.

An adjusting ring which is rotatable in the circumferential direction for adjusting the stator blades of a ring, is also disclosed in EP 1 524 413 A2.

Furthermore, it is known to radially support the adjusting rings on the stator blade carrier in each case by roller blocks, wherein the adjusting rings can move freely in the circumferential direction on the rollers of the roller blocks. On account of the fact that the material temperature of the stator blade carrier in operation is higher than that of the outside adjusting ring, a radial relative movement ensues between stator blade carrier and the adjusting ring. The magnitude of the relative movement increases on account of the temperature which increases from stage to stage of the stator blade carrier. In order to prevent the loading of the contact points between the rollers and the bearing surface of the adjusting ring from increasing unacceptably on account of this relative movement, the roller blocks are flexibly supported on disk spring packs. The disk spring packs, however, allow a movement of the adjusting ring in the axial direction on account of the axial forces which arise from the reaction forces of the adjustable blades. This leads on one hand to flow losses in the compressor on account of the asymmetrically or differently adjusted stator blades of the ring, as the case may be, when viewed over the circumference, and on the other hand also leads to wear on the support of the adjusting ring and also on the adjusting ring itself.

SUMMARY OF INVENTION

Accordingly, the object of the present invention is the creation of a wear-free and reliable device for support of an adjusting ring, which encompasses at a distance a basically circular blade carrier, for adjusting the radially extending blades of a ring which are rotatable around their longitudinal axis.

According to the invention, the device provides a plurality of single-arm levers between the blade carrier and the adjusting ring, which levers are distributed over the circumference, extend tangentially in each case, and which on their free ends have a rotatable roller in each case, which are rollable in the circumferential direction on the adjusting ring or on the blade carrier. By the use of the single-arm levers, which are flexible in the radial direction, the previously possible movability of the adjusting ring in the axial direction is suppressed since the lever, which is clamped tightly on one side, has an especially high rigidity in the axial direction. On account of the especially high axial rigidity, the levers can absorb and compensate the axial forces which arise from the reaction forces of the adjustable stator blades without additional constructional elements, such as disk springs, holders or guide elements.

By the proposed embodiment, therefore, a support for the adjusting ring can be disclosed which enables only a rotational movement of the adjusting ring which is orientated in the circumferential direction, and which suppresses a tilting or partial displacement, as the case may be, in the axial direction. By this, wear on the adjusting ring, on the fastening of the single-arm levers, and on the rotatable rollers, which are rollable in the circumferential direction on the adjusting ring or on the blade carrier, is avoided. At the same time, a constantly symmetrical adjustment of the blades of a ring of a turbo-engine is ensured so that no losses occur in the medium which flows around the blades of the ring of the turbo-engine. The efficiency of the turbo-engine is permanently maintained.

The first end of each lever which faces away from the roller is tightly clamped, for example, on the blade carrier and the roller, which is rotatably mounted on it, is rollable on the inner side of the adjusting ring. By this, a simple design is achieved since the lever in the circumferential direction is fastened tangentially on the blade carrier. The lever can then be simply formed as a strut or a transverse beam which is rectangular in cross section. The rotatably mounted roller is provided on the second free ends of the levers in each case, which roller in this case is rollable on the inner side of the adjusting ring, i.e. on its inner circumferential surface.

Advantageous developments of the invention are disclosed in the dependent claims.

Preferably, each roller is rotatable around a roller axis which is parallel to the center axis. This enables the use of cylindrical surfaces on the adjusting ring or on the blade carrier, upon which similarly cylindrical rollers are rollable.

Each lever is expediently screwed to the blade carrier so that an especially simple fitting and removal of the lever or levers, as the case may be, on the blade carrier is possible. In order to enable larger tolerances during manufacture of the levers and to adjust a defined pretensioning which presses the roller, which is rotatably mounted on the lever, onto the inner side of the adjusting ring or onto the blade carrier, each lever has at least one elongated hole, which extends in the tangential direction, for accommodating the screwed fitting. As a result of this, the desired pretensioning of the lever can be steplessly adjusted since the free flexible length of each lever between the ends can be varied.

In order to prevent a slipping off of the rollers from the inner side of the adjusting ring, an endlessly encompassing annular groove is provided on the inner side of the adjusting ring, with a groove base upon which the rollers are rollable.

The groove walls of the annular groove guide the rollers and so prevent the slipping off of the rollers from the bearing surface.

The device for support of an adjusting ring is especially advantageously usable in a turbo-engine, for example in an axial compressor, including a multi-stage axial compressor, if applicable, wherein the drive for adjusting the blades has an adjusting ring which encompasses the blade carrier, which adjusting ring is supported as claimed in one of the claims.

The blades can be formed as stator blades or also as adjustable inlet guide vanes of a compressor. Also, the invention could be used in a steam turbine which has adjustable inlet guide vanes or stator blades.

BRIEF DESCRIPTION OF THE DRAWINGS

Further explanation of the invention follows with reference to the exemplary embodiment which is shown in the drawing.

In detail in the drawings.

DETAILED DESCRIPTION OF INVENTION

Figure 1:
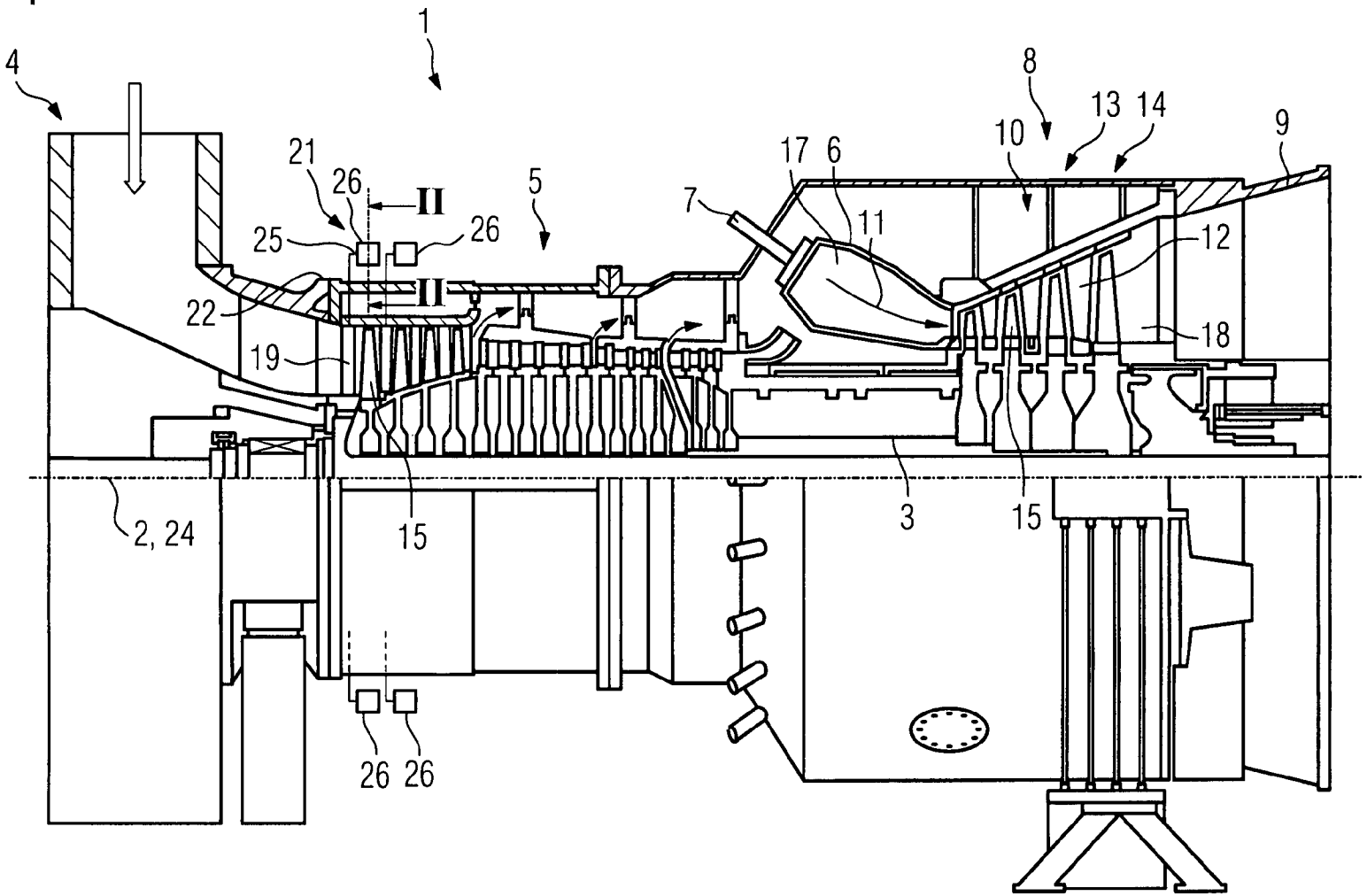
FIG. 1 shows a gas turbine with a compressor in a longitudinal partial cross section and FIG. 2 shows a roller block, which is clamped on one side, for support of the adjusting ring.

FIG. 1 shows a gas turbine 1 in a longitudinal partial section. Inside, it has a rotor 3, which is also designated as a turbine rotor, which is rotatably mounted around a rotational axis 2. An intake duct 4, a compressor 5, a toroidal annular combustion chamber 6 with a plurality of burners 7 which are arranged axially symmetrically to each other, a turbine unit 8 and an exhaust duct 9, are arranged in series along the rotor 3. The annular combustion chamber 6 forms a combustion space 17 which communicates with an annular hot gas passage 18. There, four turbine stages 10, which are connected one behind the other, form the turbine unit 8. Each turbine stage 10 is formed from two blade rings. Viewed in the flow direction of a hot gas 11 which is produced in the annular combustion chamber 6, a row 14 which is formed from rotor blades 15 follows a stator blade row 13 in each case in the hot gas passage 18. The stator blades 12 are fastened on the stator, whereas the rotor blades 15 of a row 14 are attached on the rotor 3 by means of a turbine disk. A generator or a driven machine (not shown) is coupled to the rotor 3.

Adjustable inlet guide vanes 19 are provided at the inlet of the compressor 5 on the intake duct side. The inlet guide vanes 19 are arranged radially in the annular flow passage of the compressor 5 and can be rotated around their respective longitudinal axis by a drive device 21 in order to adjust the mass flow which flows through the gas turbine 1. Depending on angle of incidence of the inlet guide vanes 19, an especially large or a small mass flow can flow through the gas turbine 1 to satisfy demands. In order to prevent flow losses in the inducted ambient air and to prevent an oscillation excitation of rotating rotor blades 15 directly downstream of the inlet guide vanes 19, which takes place in the case of an unevenly strong incident flow of the rotor blades 15 when viewed over the circumference, all the inlet guide vanes 19 are adjusted synchronously, with constant maintaining of identical angles of incidence.

The drive is effected by an adjusting ring 26 which encompasses the casing of the compressor 5, and which is coupled by levers 25 to the inlet guide vanes 19. For adjustment of the angle of incidence of the inlet guide vanes 19 to suit demands, the adjusting ring 26 is rotatable in the circumferential direction around the center axis 24.

Figure 2:
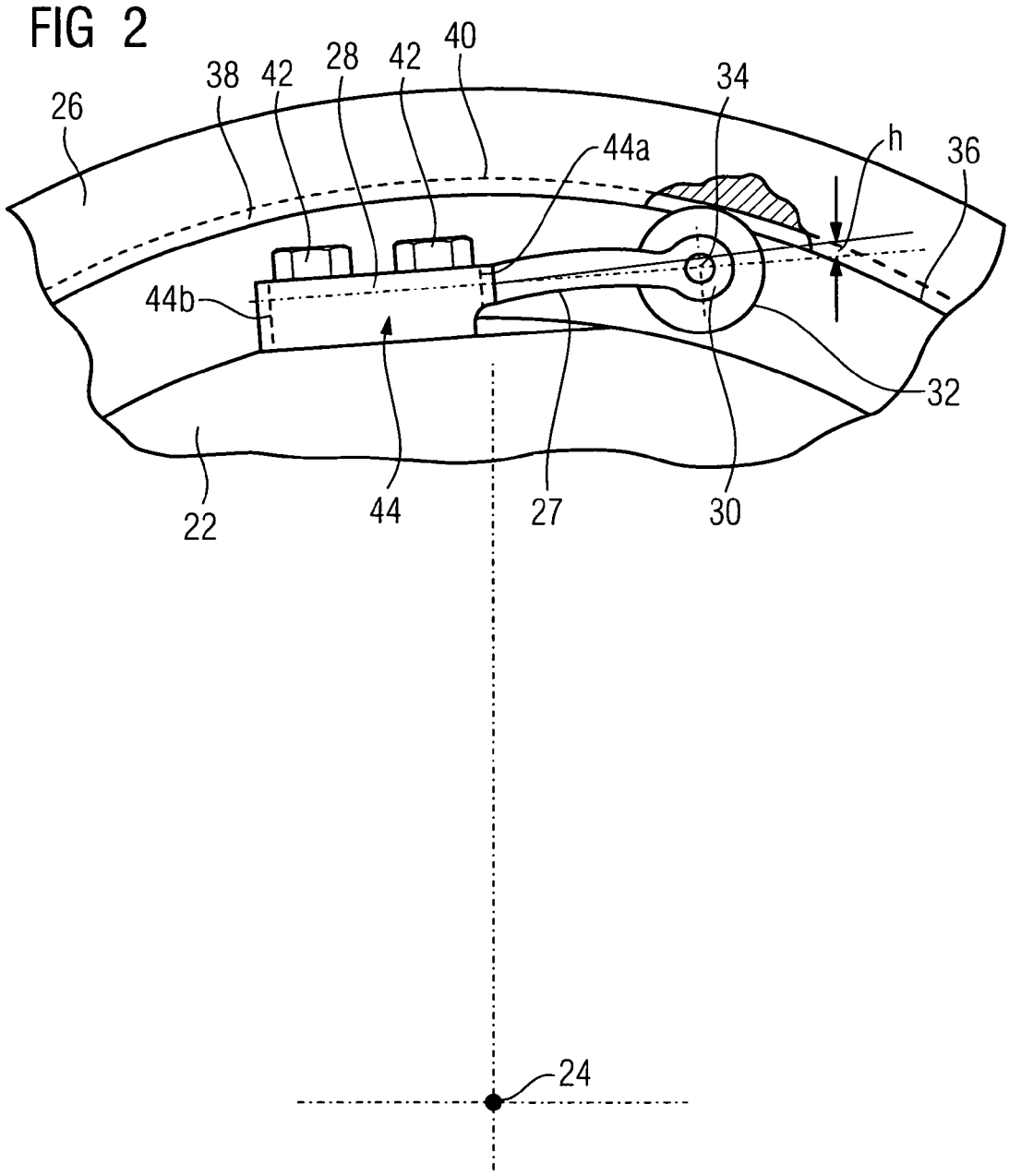

FIG. 2 shows a detail from a cross section through the compressor 5 according to the section line II in the region of the blade carrier 22. The blade carrier 22, which is formed as a stator blade carrier, is basically circular in cross section and is encompassed by the adjusting ring 26 which is concentric to its center axis 24. The adjusting ring 26 serves for the drive of radially extending inlet guide vanes 19 of the compressor 5, the blade airfoils of which form in the annular flow passage of the compressor 5 a ring-shaped blade cascade for adjustment of the mass flow.

Since the subject of the adjustment of the blades in dependence upon the rotation of the adjusting ring, which is oriented in the circumferential direction, is not subject of the invention, this drive mechanism is not elaborated upon further. For example, this could be designed according to EP 1 524 413. Other variants and developments are also possible.

The device for support of the adjusting ring 26 can also be used or provided, as the case may be, for an adjusting ring 26 which is used for the drive of adjustable stator blades of the compressor 5.

In order to mount the adjusting ring 26 concentrically around the center axis 24 of the compressor 5, a plurality of single-arm levers 27 are provided, which are distributed over the circumference of the blade carrier 22, which levers have a tightly clamped end 28 and a free end 30 which lies opposite this. The fixed end 28 of the lever 27 is screwed on the support side, i.e. on the blade carrier 22. In the exemplary embodiment which is shown, two commercially available screws 42 are used for this purpose, which rigidly connect the clamped end 28 to the blade carrier 22. A roller 32 is provided on the free end 30 of the lever 27, the rotational axis 34 of which is oriented parallel to the center axis 24.

The adjusting ring 26 on its inner side 36 has an endlessly encompassing annular groove 38 in which each roller 32 of the device engages so that these are rollable on the groove base 40 of the annular groove 38.

Each lever 27 is designed in its dimensions in such a way that this presses the roller 32, which is rotatably mounted on its free end 30, under a pretensioning onto the inner side 36 or onto the groove base 40 of the annular groove 38, as the case may be. As a measure for the pretensioning force, the measure h can be specified, which describes the spacing of the rotational axis 34 between pretensioned position and relaxed position, i.e. without adjusting ring 26.

The device preferably has an odd number, for example five or seven, of such levers 27, in order to mount the adjusting ring 26 concentrically around the center axis 24. An even number of levers 27, however, is also conceivable.

Each lever 27, which is also designated as a roller block, has on its fixed end 28 on the support side at least one elongated hole 44 for one or preferably more screws 42. By the use of elongated holes 44, the lever 27 is movable in the tangential direction before screwing down so that the spacing of the rotational axis 34 and center axis 24, viewed in the radial direction, can be adjusted, as a result of which the magnitude of the pretensioning by which the lever 27 presses the roller 32 onto the inner side 36 of the adjusting ring 26 or onto the groove base 40, as the case may be, can be especially simply adjusted. In particular, the use of two or more screws 42 prevents a twisting of the lever 27 around its radial axis, for example around the longitudinal axis of a screw. As a rule, all levers 27 which are distributed over the circumference have the same pretensioning in order to concentrically support the adjusting ring 26.

If the lever 27 is screwed on the blade carrier 22 in such a way that the end 44*a* of the elongated hole which faces the roller lies upon the screw which is shown on the right, then the pretensioning is less than in the position in which the outer end 44*b* of the elongated hole 44 lies upon the screw which is shown on the left.

On account of the levers 27 which are tightly clamped on the support side, these prevent a displacement or movement of the adjusting ring 26 occurring in the axial direction, which previously could take place on account of the reaction forces of the medium which flows around the blades.

In addition, the rollers 32 which are guided in an endlessly encompassing annular groove 38, the axial width of which rollers corresponds approximately to the width of the annular groove 38, reliably prevent a tilting of the adjusting ring 26 or its axial displacement, as the case may be. Correspondingly, the rollers 32, which are guided by the groove walls, guide the adjusting ring 26.

List of Designations

1 Gas turbine
2 Rotational axis
Rotor
Intake duct
Compressor
Annular combustion chamber
Burner
Turbine unit
Exhaust duct
Turbine stages
Hot gas
Stator blades
Stator blade row
Row
Rotor blades
Combustion space
Hot gas passage
Inlet guide vanes
Stator blade carrier
Center axis
Adjusting ring
Lever
End
End
Roller
Rotational axis
Inner side
Annular groove
Groove base
Screws
Elongated holes

The invention claimed is:

1. A device for supporting a rotatably adjustable ring coaxial with a circular blade carrier about a center axis of the blade carrier of a compressor, comprising:

a plurality of levers arranged between the blade carrier and the adjusting ring, the levers being distributed over the circumference of the adjustable ring and extending tangentially from the blade carrier to the adjustable ring, wherein the levers are fixed at one end to the blade carrier and have a free end opposite the fixed end that is arranged toward the adjustable ring; and a plurality of rotatable rollers each arranged at the free end of the plurality of levers where each roller is rollable in a circumferential direction on the adjusting ring or on the blade carrier, wherein each lever is adjustably fixed to the blade carrier by a screw, and wherein each lever has an elongated hole extending in the tangential direction that accommodates the screw.

2. The device as claimed in claim 1, wherein each roller is rotatable around a rotational axis parallel to the center axis.

3. The device as claimed in claim 2, wherein each roller is rollable on an inner side of the adjusting ring.

4. The device as claimed in claim 1, wherein each lever is fixed by a plurality of screws.

5. The device as claimed claim 4, wherein each lever presses the roller under a pretension force onto the inner side of the adjusting ring or onto the blade carrier.

6. The device as claimed in claim 5, wherein the adjusting ring has an encompassing annular groove with a groove base on the inner side where the rollers roll.

7. A turbo-engine with a blade carrier, comprising:

a rotor that rotates about a rotational axis of the engine having a plurality of rotor blades;

an inlet that admits a working fluid;

a compressor section connected to the inlet and receives and compresses the working fluid and produces a compressed fluid flow;

a plurality of stationary blades;

a blade carrier;

an adjusting ring coaxially surrounding the blade carrier;

a plurality of adjustable guide blades arranged on an inner side of the blade carrier;

a plurality of levers arranged between the blade carrier and the adjusting ring, the levers being distributed over the circumference of the adjustable ring and extending tangentially from the blade carrier to the adjustable ring, wherein the levers are fixed at one end to the blade carrier and have a free end opposite the fixed end that is arranged toward the adjustable ring, wherein each lever is adjustably fixed to the blade carrier by a screw, and wherein each lever has an elongated hole extending in the tangential direction that accommodates the screw;

a plurality of rotatable rollers each arranged at the free end of the plurality of levers where each roller is rollable in a circumferential direction on the adjusting ring or on the blade carrier;

a combustion section that receives the compressed fluid flow, mixes the compressed fluid flow with a fuel and combusts the mixture to produce a hot fluid flow; and a turbine section that expands the hot fluid to extract mechanical energy.

8. The turbo-engine as claimed in claim 7, wherein the stationary blades are compressor blades or inlet guide blades.

* * * * *